US010898790B2

(12) United States Patent
Smith

(10) Patent No.: US 10,898,790 B2
(45) Date of Patent: Jan. 26, 2021

(54) PUZZLE

(71) Applicant: Wotch Creations Ltd., Walsall (GB)

(72) Inventor: Thomas Colin Smith, Bloxwich (GB)

(73) Assignee: WOTCH CREATIONS LTD, West Midlands (GB)

( * ) Notice: Subject to any disclaimer, the term of this patent is extended or adjusted under 35 U.S.C. 154(b) by 0 days.

(21) Appl. No.: 16/645,943

(22) PCT Filed: Feb. 11, 2019

(86) PCT No.: PCT/GB2019/050356
§ 371 (c)(1),
(2) Date: Mar. 10, 2020

(87) PCT Pub. No.: WO2019/207275
PCT Pub. Date: Oct. 31, 2019

(65) Prior Publication Data

US 2020/0197790 A1 Jun. 25, 2020

(30) Foreign Application Priority Data

Apr. 25, 2018 (GB) ..... 1806760.3

(51) Int. Cl.
*A63F 9/12* (2006.01)
*A63F 9/06* (2006.01)

(52) U.S. Cl.
CPC ..... *A63F 9/1204* (2013.01); *A63F 9/0669* (2013.01); *A63F 9/1208* (2013.01);
(Continued)

(58) Field of Classification Search
CPC ..... A63F 9/1204; A63F 2009/1212; A63F 9/0669; A63F 9/1288; A63F 9/1208;
(Continued)

(56) References Cited

U.S. PATENT DOCUMENTS 2,711,595 A * 6/1955 Sharp ..... G09B 1/06 434/159
2,957,251 A * 10/1960 Nystad ..... A63F 9/12 434/147

(Continued)

FOREIGN PATENT DOCUMENTS

EP 0164861 A2 * 12/1985 ..... A63F 9/12
GB 293940 7/1928

(Continued)

OTHER PUBLICATIONS

International Search Report and Written Opinion for PCT/GB2019/050356 dated Apr. 23, 2019, 9 pages.

(Continued)

*Primary Examiner* — Steven B Wong
(74) *Attorney, Agent, or Firm* — Myers Bigel, P.A.

(57) ABSTRACT

A puzzle kit and a puzzle constructed from said puzzle kit. The puzzle kit comprises a three dimensional substrate having an outer surface, and a plurality of puzzle pieces that cannot interlock. Each puzzle piece has a first surface and an opposite second surface and a thickness defined between the first and second surfaces. Each puzzle piece comprises first attachment means and the outer surface of the substrate defines a plurality of complementary second attachment means, such that the first attachment means and the second attachment means magnetically attach each puzzle piece to the outer surface. The first attachment means comprises a projection extending from the second surface of the puzzle piece. The second attachment means comprises a hole to partly receive the projection.

14 Claims, 5 Drawing Sheets

(52) U.S. Cl.
CPC ..... *A63F 9/1288* (2013.01); *A63F 2009/068* (2013.01); *A63F 2009/0681* (2013.01); *A63F 2009/1212* (2013.01); *A63F 2009/1224* (2013.01)

(58) Field of Classification Search
CPC ..... A63F 2009/068; A63F 2009/0681; A63F 2009/1224; A63F 2009/124; A63F 9/12
See application file for complete search history.

(56) References Cited

U.S. PATENT DOCUMENTS 2,987,318 A * 6/1961 Hammer ..... A63F 9/12 273/157 R
3,851,884 A * 12/1974 Myller ..... A63F 9/12 273/157 R
3,909,003 A * 9/1975 Rabinovich ..... A63F 9/10 273/157 R
4,050,184 A * 9/1977 Chiari ..... A63H 33/101 446/86
5,165,689 A * 11/1992 Forsse ..... A63F 9/1288 273/157 R
5,895,044 A * 4/1999 Bahramian ..... A63F 9/1288 273/156
6,015,150 A * 1/2000 Giguere ..... A63F 9/12 273/156
6,116,979 A * 9/2000 Weber ..... A63F 9/1208 273/157 R
6,805,350 B1 * 10/2004 Wu ..... A63B 43/00 273/156
7,021,625 B2 * 4/2006 Simmons ..... A63F 9/001 273/157 R
7,155,851 B2 * 1/2007 Ootsuka ..... A47G 1/12 40/600
2002/0135125 A1 * 9/2002 Wu ..... A63F 9/12 273/156
2003/0118756 A1 * 6/2003 Chuang ..... B32B 1/00 428/33
2003/0173738 A1 9/2003 Simmons
2005/0248090 A1 * 11/2005 Anders ..... A63F 9/0865 273/156
2006/0033271 A1 * 2/2006 Wu ..... A63F 9/12 273/153 S
2006/0255538 A1 * 11/2006 Chen ..... G09B 27/08 273/156

FOREIGN PATENT DOCUMENTS

GB 1284872 8/1972
GB 2129312 5/1984
GB 2139512 11/1984
WO WO-2010039052 A1 * 4/2010 ..... A63F 9/12
WO WO-2019040697 A1 * 2/2019 ..... A63H 33/046

OTHER PUBLICATIONS

Search Report for corresponding GB application No. 1806760.3 dated Oct. 17, 2018, 1 page.

* cited by examiner

PUZZLE

RELATED APPLICATIONS

The present application is a 35 U.S.C. § 371 national phase application of PCT International Application No. PCT/GB2019/050356, filed Feb. 11, 2019, which claims priority from GB Application No. 1806760.3 filed Apr. 25, 2018, the disclosures of which are hereby incorporated herein by reference in their entirety.

FIELD OF THE INVENTION

The present invention relates to a puzzle kit, a puzzle and components thereof.

BACKGROUND OF THE INVENTION

The completion of puzzles, such as tiling puzzles, has been attributed to various health benefits. For example, at a young age, completing puzzles allows the user to develop their spatial awareness, strategy and mental agility. For older users, completing puzzles may to increase life span and reduce the chance of falling prey to conditions such as Alzheimer's disease, memory loss and dementia.

Jigsaw puzzles make up a large proportion of tiling puzzles. The tiles of jigsaw puzzles interlock to join one puzzle piece with another. The individual pieces of traditional, two-dimensional, tiling puzzles are typically produced by a punching process and therefore have some play in the assembled state along the connecting edges of the individual jigsaw puzzle pieces. Many conventional two-dimensional puzzles, for example, cannot therefore be lifted in the assembled state, since individual puzzle pieces separate again when attempting to lift.

Three-dimensional jigsaw puzzles are known, including those where the assembled puzzle pieces result in a hollow body such as a globe. The individual puzzle pieces must be manufactured within much finer tolerances to allow the pieces to join together strongly. In such three-dimensional puzzles, there is little to no play on the connecting edges of the individual puzzle pieces as compared to the aforementioned two-dimensional puzzles, but the individual puzzle pieces are manufactured so that their joining results in a more or less strong clamping effect. To meet these fine tolerances and provide increased structural integrity, three-dimensional tiling puzzle pieces are usually made of plastic by injection moulding.

GB293940 (1928), U.S. Pat. No. 2,987,318 (1961), GB2139512 (1984) and US2003/173738A1 describe puzzles having a three dimensional base member. Jigsaw pieces are attached to the base member (e.g. using pegs and peg holes) and interlock with each other in the conventional way to form a surface.

U.S. Pat. No. 2,957,251 (1960) describes a globe puzzle comprising a spherical sectioned shell constituting a globe, said shell having a series of spaced slots therein, the series of slots being arranged along vertically disposed curved lines constituting the lines of longitude.

GB1284872 (1968) describes a globe jigsaw puzzle having a spherical frame upon which generally triangular pieces are placed. The frame is preferably provided with equilaterally triangular peg holes and each piece is provided with an equilaterally triangular peg.

SUMMARY OF THE INVENTION

The inventor has determined that conventional three-dimensional jigsaw puzzles suffer drawbacks. For example, they may suffer from fragility and this fragility can make certain types of shapes, such as tightly folded shapes or shapes that contain openings in the plane of the surface of a puzzle unsuitable for conventional three-dimensional jigsaw puzzles. For example, a helmet shape has an opening in the plane of the outer surface and would be unsuitable to be made by a conventional three-dimensional puzzle due to a lack of support of the pieces above the opening, i.e. in the region typically covered by the forehead when worn.

Injection moulding, typically used to produce puzzle pieces of conventional three-dimensional puzzles, is labour-intensive and expensive. Individual moulds must be produced and maintained for each piece. Furthermore, the tolerances with which pieces must be manufactured are very fine, especially when the puzzle is designed to be strong enough to be held and manipulated by a user. This naturally raises the precision and resource required to manufacture the pieces of conventional three-dimensional puzzles, which makes such puzzles more expensive than conventional two-dimensional puzzles.

According to a first aspect of the invention, there is provided a puzzle kit comprising: a three-dimensional substrate having an outer surface; and a plurality of puzzle pieces that cannot interlock with each other, each puzzle piece having a first (front) surface and an opposite second (back/rear) surface and a thickness defined between the first and second surfaces;

each puzzle piece comprising first attachment means and the outer surface of the substrate defining a plurality of complementary second attachment means, such that the first attachment means and the second attachment means attach each puzzle piece to the outer surface;

wherein the first and second attachment means are configured to magnetically attach at least one puzzle piece to the outer surface, the puzzle piece having first attachment means comprising a projection extending from the second surface of the puzzle piece and the outer surface having complementary second attachment means comprising a hole to partly receive the projection.

It will be appreciated that a puzzle can be constructed from the kit and the invention also resides in the puzzle. Once constructed (assembled), the plurality of puzzle pieces together form a puzzle layer. The puzzle pieces may tessellate to form the puzzle layer.

According to a second aspect of the invention, there is provided a puzzle comprising: a three-dimensional substrate having an outer surface; and a plurality of puzzle pieces that cannot interlock with each other, each puzzle piece having a first (front) surface and an opposite second (back/rear) surface and a thickness defined between the first and second surfaces;

each puzzle piece comprising first attachment means and the outer surface of the substrate defining a plurality of complementary second attachment means, such that the first attachment means and the second attachment means attach each puzzle piece to the outer surface;

wherein the first and second attachment means magnetically attach at least one puzzle piece to the outer surface, the puzzle piece having first attachment means comprising a projection extending from the second surface of the puzzle piece and the outer surface having complementary second attachment means comprising a hole that partly receives the projection thereby forming a puzzle layer spaced from the outer surface.

The puzzle kit of the invention provides benefits relative to known puzzle kits. In particular the attachment means provides a useful tilting mechanism, which allows the user to easily manipulate the puzzle pieces.

The puzzle piece is magnetically attached to the substrate by means of a projection which is only partly received within a complementary hole. This means that the projection is longer than the depth of the hole, such that the puzzle piece is spaced from the outer surface of the substrate. As such, a user can push down on a peripheral edge of the puzzle piece, forcing that edge closer to the substrate. The projection can be viewed as a pivot or fulcrum, forcing the opposite edge of the puzzle upwards, away from the substrate. The magnetic attachment allows the puzzle piece to move within the hole to facilitate this movement. If the puzzle piece were tightly fixed within the hole, pushing down on an edge of puzzle piece would risk breakage of the piece.

The projection may have a longitudinal axis generally perpendicular to the rear face. The length of the projection can be measured along the axis and a diameter can be measured in a plane perpendicular to the axis. The hole has a depth which can be measured along the axis of the projection and a diameter that can be measured in a plane perpendicular to the axis.

The projection is partly received within the hole. Hence, the depth D of the hole is less than the length L of the projection i.e. D<L. The depth D may be 99% or less, 95% of less, 90% or less, 85% or less, 80% or less, 75% or less or 70% of less of the length L of the projection and/or the depth D may be 20% or more, 30% or more, 40% or more, 50% or more or 60% or more of the length L of the projection. The inventor has determined that a depth D of 50 to 80% of the length L, such as D=55 to 75% L, is particularly beneficial for achieving an effective tilting mechanism. If the projection is too long (relative to the depth) then the puzzle piece can lack stability (it wobbles) but if the projection is short (relative to the depth), then there is less room for tilting.

The diameter of the projection may be uniform, i.e. the same at each point along its length. Typically, the projection tapers (narrows) away from the rear face. This helps the projection move within the hole.

The diameter of hole may be uniform, i.e. the same at each point along its depth. Alternatively the hole may have a non-uniform diameter, e.g. the diameter of the hole may taper (narrow) as it gets deeper.

The diameter of the projection and the diameter of the hole are complementary so that the projection fits within the hole. Each of the projection and the hole may taper to provide a snug fit.

The diameter of the projection may be compared to the diameter of the first surface of the puzzle piece. The maximum diameter of the first surface is greater than the maximum diameter of the projection. The maximum diameter of the first surface may be at least 2, at least 3, at least 4 or at least 5 times the maximum diameter of the projection and/or the maximum diameter of the first surface may be no more than 10 times, no more than 8 times or no more than 5 times the maximum diameter of the projection. It will be appreciated that the relative sizes of the first surface and the projection will affect how the puzzle piece tilts in use.

The projection may comprise a magnet and/or the substrate may comprise a magnet. The magnet or magnets may comprise neodymium magnets.

The projection may extend from the centre point of the rear face. The projection may be described with reference to its cross-section measured in a plane perpendicular to its length. The cross-section may be circular, triangular, rectangular (including square), pentagonal, hexagonal, heptagonal or octagonal for example. The projection may have a cross-section that is a regular polygon, in particular a hexagonal projection.

The cross-section of the projection may match the shape of the first surface of the puzzle piece. For example, a hexagonal puzzle piece may have a hexagonal projection which partly fits within a hexagonal hole.

The projection and the hole may have the same cross-section, e.g. both the projection and the hole may have a hexagonal cross-section.

The puzzle kit of the present invention solves problems encountered with conventional three-dimensional jigsaw puzzles that do not have a substrate. Since the substrate supports the pieces of the puzzle, the requirement for structural integrity of the pieces on their own, and in the interlocking connection between a pair of pieces, is avoided. The substrate may define a void and/or an opening. For example, the substrate may be in the shape of a helmet. In this way the helmet has an opening through which the user can see. It will be appreciated that the puzzle kit is not intended to be employed for safety purposes. The puzzle kit may be customised and thereby serve as merchandise.

The present invention also avoids the need for the precise manufacturing methods that are required for conventional three-dimensional jigsaw puzzles, because neither the pieces nor the connections between the pieces are structural to the puzzle. This can make the puzzles more simple to design and manufacture, and reduces the manufacturing cost of such puzzles.

According to a third aspect of the invention, there is provided a puzzle kit comprising: a three-dimensional substrate having an outer surface; and a plurality of puzzle pieces that cannot interlock with each other;

each puzzle piece being configured to attach to the outer surface of the substrate, wherein (i) at least one puzzle piece may be hexagonal and/or (ii) the outer surface has the shape of a helmet.

According to a fourth aspect of the invention, there is provided a puzzle comprising: a three-dimensional substrate having an outer surface; and a plurality of puzzle pieces that cannot interlock with each other, wherein each puzzle piece is attached to the outer surface of the substrate and thereby forms a puzzle layer upon the outer surface or spaced from the outer surface;

wherein (i) at least one puzzle piece may be hexagonal and/or (ii) the outer surface has the shape of a helmet.

DETAILED DESCRIPTION OF THE INVENTION

Substrate

The puzzle kit comprises a three-dimensional substrate having an outer surface.

The substrate may be in any suitable shape that is desired. It will be understood that the present invention provides benefits for any three-dimensional puzzle.

The substrate may be hollow (having an empty space/void inside) or solid. The substrate is typically hollow and therefore has an inner surface in addition to its outer surface, the inner surface defining the void. The outer surface of the substrate may have an opening therein. The outer surface of the substrate may include an arch that spans the opening and thereby supports the weight above it.

It will also be appreciated that the kit is particularly useful for making puzzles having a hollow three-dimensional shape, and especially those having an opening in the puzzle layer, such as a helmet.

The outer surface of the substrate may be a single curved surface, such as a globe or helmet. Alternatively a number of portions (e.g. planar and/or curved portions) may together form the outer surface of the substrate, e.g. a cube or cylinder.

In one embodiment, the outer surface has the shape of a helmet. Exemplary helmets include full face helmets, which are designed to cover the entire head with except for an opening for the eye region; a modular helmet, where the whole head is covered but the face region is typically able to flip up above the user's forehead, revealing an opening beneath; open face helmets, which comprise an opening in the face region; and half helmets, which protect the cranium and also comprise an opening in the face region.

The outer surface of the substrate may define at least one opening i.e. the outer surface of the substrate may form a perimeter of an opening. In one embodiment, the outer surface defines two or more openings. For example, if the puzzle is in the shape of a full face helmet, the outer surface may define an opening for the visor and another opening in a base, where a user would insert their head into the helmet. It will be understood that such openings are not directly related to the first attachment means or the second attachment means.

An opening may be circular, oval or obround, for example. The opening may have a diameter of 2 cm or more, 5 cm or more, the diameter being measured as the smallest dimension through the centre of the opening. In one embodiment, the opening is 7 cm or more, or 10 cm or more in diameter wherein the diameter is measured as the smallest dimension through the centre of the opening.

In one embodiment, the outer surface of substrate may be in the shape of a helmet used by a particular mode of racing, racing team, racing driver, sports team, or fictional character.

The outer surface of the substrate may have a range of shapes and/or structures. The aligned or tessellated puzzle pieces may form a puzzle layer that corresponds with the shape of a helmet used by a particular mode of racing, racing team, racing driver, sports team, or fiction character, either in the past or in the present.

For example, the outer surface of the substrate and/or the puzzle layer may be shaped to correspond with a helmet used in Moto GP, Formula 1, Nascar, IndyCar, World Superbikes, British Superbikes, or Isle of man TT racing. The outer surface of the substrate and/or the puzzle layer may be shaped to correspond with a helmet used in American football, hockey, ice hockey, baseball or cricket.

The shipping of three-dimensional products can be expensive because of the volume that they take up; the same weight of product in a smaller volume can cost less to ship. Therefore, reduction of the volume of the substrate is desirable for cost-effective shipping. Designing the substrate to be formed of more than one part that can be assembled after delivery will facilitate cost-effective shipping of the substrate.

Accordingly, the substrate may be formed of one or more individual parts that attach together. Therefore, in one embodiment, the substrate is comprised of two or more parts that attach together. For example, the substrate may be comprised of three or more, such as four parts that attach (join) together. The substrate may be assembled by the retailer or the end user, for example.

The individual parts of the substrate may clip together. For example, the parts of the substrate may attach together using tongue and groove attachment, wherein a tongue on one part can insert into a groove on another part, and wherein a resilient barb on the tongue and/or groove attaches to a recess on the corresponding part to hold the individual parts of the substrate in an attached state.

For example, the substrate may be formed of two parts, wherein the two parts of the substrate are attached together by three tongue and groove attachments. In one embodiment, each of the two parts forms about half of the substrate.

The parts of the substrate may be provided to the user in an assembled state. In one embodiment, the parts of the substrate may be provided to the user in an unassembled state.

The substrate may be any suitable size. For example the substrate may be about 5 cm to about 1 m in size in its greatest (maximum) dimension, such as from about 10 cm to about 50 cm in size in a greatest dimension. Preferably, the substrate is about 15 cm to about 40 cm in size in its greatest dimension. It will be understood that the substrate should be smaller than the intended size of the assembled puzzle because the puzzle pieces will add to the size of the substrate once assembled.

The outer surface of the substrate may have a surface area of 50 $cm^2$ or more, 100 $cm^2$ or more, 250 $cm^2$ or more, 500 $cm^2$ or more, 1000 $cm^2$ or more, or 2000 $cm^2$ or more and/or the outer surface of the substrate may have a surface area of 10000 $cm^2$ or less, 5000 $cm^2$ or less, 2500 $cm^2$ or less, or 1000 $cm^2$ or less.

The substrate may be made from any suitable material. For example, the substrate may be made from one or more of paperboard, wood, plastics (e.g. polypropylene) or metal. Preferably the substrate is made from plastics.

Puzzle Pieces

The puzzle kit comprises a plurality of puzzle pieces that cannot interlock, i.e. they are not conventional interlocking jigsaw pieces. A puzzle piece may alternatively be termed a tile or a component. When the puzzle is constructed by the user, the plurality of puzzle pieces form a puzzle layer upon the outer surface of substrate or spaced from the outer surface of substrate.

The kit may comprise at least 5, at least 10, at least 20, at least 30, at least 50, at least 100, at least 500 or at least 1000 puzzle pieces and/or the kit may comprise no more than 3000, no more than 2000, no more than 1000, no more than 500 or no more than 100 pieces. The complexity of the puzzle will depend in part on the number of puzzle pieces.

Each of the puzzle pieces may be identical (i.e. same size, shape and decoration). Alternatively, the plurality of puzzle pieces are not identical, i.e. the plurality of puzzle pieces have a variety of characteristics such as size, shape and decoration.

The plurality of puzzle pieces may be the same shape or may be different shapes. At least one puzzle piece may, for example, be triangular, square, pentagonal or hexagonal. A puzzle piece may even be circular and a suitably curved puzzle piece may be employed to tessellate with the circular piece.

A majority of the plurality of puzzle pieces may have the same size and shape. At least 60%, at least 70%, at least 80%, at least 90% or at least 95% of the puzzle pieces may have the same size and shape. It may not be practical to have 100% of the pieces having the same size and shape, since the finished puzzle may require edge pieces which are different from the remaining pieces.

At least one puzzle piece may be hexagonal, such as a regular hexagon, i.e. the first (front surface) and/or the second (back/surface) may be hexagonal. At least 60%, at least 70%, at least 80%, at least 90% or at least 95% of the puzzle pieces may be hexagonal, such as regular hexagons. Hexagons provide regular tiling in two dimensions, but cannot be used to tile a sphere. Hence, a football (soccer) ball includes hexagons and 12 pentagons.

The plurality of puzzle pieces may comprise hexagonal and pentagonal puzzle pieces.

The puzzle pieces cannot interlock with one another. However, since the puzzle pieces attach to the outer surface of the substrate, there is no structural requirement for the puzzle pieces to interlock in this way. Therefore, the intricate design and construction required for jigsaw puzzles is not required. Each puzzle piece comprises a first (front) surface and a second (back/rear) surface, wherein in use the rear surface of the puzzle piece faces towards the substrate and the front surface of the puzzle piece faces away from the substrate. The front surface is typically decorated such that the resulting puzzle layer has a design thereon.

A thickness can be measured between the front and back surfaces of a piece. At least one puzzle piece may have a thickness of at least 1 mm, at least 2 mm, or at least 5 mm and/or at least one puzzle piece may have a thickness of no more than 20 mm, no more than 10 mm, or no more than 5 mm.

The plurality of puzzle pieces may have an average (mean) thickness of 1 mm or more, 2 mm or more, or 5 mm or more and/or at least one puzzle piece may have a thickness of 20 mm or less, 10 mm or 5 mm or less.

A puzzle piece may comprise a smooth front surface and a rear surface from which attachment means extend.

One or more puzzle pieces may have a convex (front) surface and a concave (rear) surface. For a generally spherical puzzle, such as a helmet shape, it will be appreciated that a majority of the pieces will need to have a convex front surface. In one embodiment, a majority (e.g. more than 50%) of the plurality of pieces have a convex surface.

At least one puzzle piece may have planar (flat) front and/or rear surface. At least one puzzle piece may have planar front surface and a planar back surface. In this way the puzzle pieces may have a design on both surfaces and can be reversible.

The rear surface of each puzzle piece may illustrate intended connections with other puzzle pieces, such as through the use of numbers and arrows. However, such illustration may be reduced or avoided to adjust the level of expertise required to complete the puzzle.

Each puzzle piece preferably contains part of a design on its front surface, such that the plurality of puzzle pieces form the full design when correctly tessellated on the substrate. In one embodiment, the design is akin to that of a "paint by numbers" scheme, whereby a user may colour in a template, such as with paint or ink or pencil. In one embodiment, the plurality of puzzle pieces comprises a variety of shapes and the puzzle pieces have no design on their front surfaces.

The puzzle pieces may be any suitable size. The size of the puzzle pieces may be varied according to the desired complexity of the puzzle. For example at least one piece (e.g. at least 50% of the puzzle pieces) may have a maximum diameter of about 5 mm to about 10 cm, such as from about 1 cm to about 5 cm. Preferably, at least one piece (e.g. at least 50% of the puzzle pieces) has a maximum diameter of about 1.5 cm to about 3 cm.

The puzzle pieces may be made from any suitable material. For example, the puzzle pieces may be made from conventional puzzle materials such as paperboard or wood, or may be made from alternative materials such as plastics (e.g. polypropylene, acrylate polymers such as acrylonitrile styrene acrylate (ASA) etc.) or metal.

Puzzle Layer

Once the kit is assembled, the puzzle pieces form a puzzle layer spaced from the outer surface of the substrate. The puzzle layer formed by the puzzle pieces may generally follow the contour of the outer surface of the substrate.

The spacing of the puzzle layer from the outer surface may be described with reference to the depth D of the hole defined in the outer surface of the substrate or the length L of the projection extending from the second surface of a puzzle piece.

The puzzle layer may be spaced from the outer surface by a (mean) distance that is less than the depth D of the hole. For example, the puzzle layer may be spaced from the outer surface by a distance that is 10 to 90% of D, 20 to 80% of D, 30 to 70% of D or 40 to 60% of D.

The puzzle layer may be spaced from the outer surface by a (mean) distance that is at least 5% L (at least 5% of the length L of the projection), at least 10% L, at least 20% or at least 30% L and/or the puzzle layer may be spaced from the outer surface by a (mean) distance of 50% L or less, 40% L or less or 30% L. For example, the puzzle layer may be spaced from the outer surface by a distance that is 30 to 50% of L.

The plurality of puzzle pieces may cover 50% or more of the outer surface of the substrate, such as 65% or more of the outer surface. For example the pieces may cover 75% or more of the outer surface of the substrate, such as 95% or more of the outer surface of the substrate. The plurality of pieces may substantially cover the outer surface of the substrate. The plurality of pieces may tessellate to cover the outer surface of the substrate.

The puzzle layer may be continuous. i.e. each puzzle piece may abut at least one other puzzle piece.

The puzzle layer may define one or more openings, where the opening in the puzzle layer is defined between puzzle pieces. For example, if the puzzle is in the shape of a full face helmet, the puzzle layer may define an opening for the visor and another opening in the base, where a user would insert their head into the helmet. It will be understood that such openings are not directly related to the first attachment means or the second attachment means (discussed below). In one embodiment, the puzzle layer defines one or more openings, such as two or more openings. The opening may be circular, oval or obround, for example.

The puzzle layer may define an opening suitably large that other types of tile puzzle would be completely ineffective. It will be appreciated that conventional three-dimensional puzzles will be unsuitable for shapes that define a large opening, particularly a large horizontal opening, because the forces that must transfer from the puzzle pieces above the void, around the sides of the void will be too large for the puzzle pieces to hold together robustly. The puzzle would either collapse under its own weight or be very fragile.

The smallest diameter of the opening in the puzzle layer may be 2 cm or more, or 5 cm or more. In one embodiment, the smallest diameter of the opening is 7 cm or more, or 10 cm or more.

The puzzle of the present invention may find particular application when the puzzle layer defines an opening that is 2 cm or more in horizontal diameter, or 5 cm or more in horizontal diameter. In one embodiment, the opening is 7 cm or more, or 10 cm or more, or 20 cm or more in horizontal diameter.

The puzzle of the present invention may find particular application when the puzzle layer defines an opening (between puzzle pieces) that comprises 5% or more of the circumference of the puzzle layer, such as 10% or more, or 20% or more. For example the opening may comprise 25% or more of the horizontal circumference of the shape.

Attachment

Each puzzle piece is configured to attach to the outer surface of the substrate. First attachments means (on the puzzle piece) and complementary second attachment means (on the outer surface) work together to fix the puzzle piece to the outer surface.

When the puzzle has been constructed, the plurality of puzzle pieces form a puzzle layer upon the outer surface of substrate or spaced from the outer surface. The puzzle layer typically illustrates a design, such as the design of a racing team helmet. In one embodiment, each puzzle piece has a preferred position for attachment to the substrate. The preferred position may be the position for that piece that allows for the puzzle layer to be correctly completed.

The first attachment means (on the puzzle piece) may be located on (e.g. extend from) a rear surface of the puzzle piece. A plurality of second attachment means may be located on the outer surface of the substrate.

The first attachment means is reversibly attachable to the second attachment means.

In this way the puzzle can be completed and taken apart many times. Significantly, users can use different collections of puzzle pieces with different designs for any one substrate.

The first attachment means may extend through a puzzle piece, thereby extending through both the front and rear surfaces of the puzzle piece. The first attachment means may be integral with a puzzle piece, such as if the first attachment means is a protrusion extending from the rear face of a puzzle piece.

In use, the first attachment means is attached to the second attachment means. In one embodiment, when a puzzle piece is attached to the substrate, the puzzle piece is able to independently rotate, relative to the substrate, about the first attachment means. In one embodiment, when a puzzle piece is attached to the substrate, the puzzle piece is able to spin relative to the substrate.

Each puzzle piece is held in a spaced relationship relative to the substrate. This might be employed to prevent any hindrance to the rotation of the puzzle piece relative to the substrate. For example, the puzzle piece may be held at a distance of 0.5 mm or more, or 1 mm or more, or 2 mm or more, or 5 mm or more, or 10 mm or more, such as 20 mm or more from the substrate.

The attachment between the first attachment means and the second attachment means may, to some extent, resist separation forces.

Additional Components

In one embodiment, the puzzle kit comprises an accessory (additional component). For example, if the puzzle is in the shape of a helmet, suitable additional components may include a visor, a sun shield, a face guard, a vent, or an aerodynamic fin.

Accessories may be fitted to the substrate, a puzzle piece or the resulting puzzle layer, for example using hooks or barbed tongues.

The attachment of the accessory to a puzzle piece or the puzzle layer may be preferable so that a different set of puzzle pieces can be used with different accessories. An accessory may be reversibly attachable to the substrate, puzzle piece or puzzle layer.

In one embodiment, the puzzle kit additionally comprises a light source. The light source may be configured to illuminate a void in a hollow substrate, such that light radiates from the void of the substrate. The light source may be configured to radiate from an opening in the substrate. In one embodiment the light source may be configured to turn on automatically when there is low ambient light, such that the light source can be used as a night light.

In one embodiment, the puzzle kit comprises a stand. For example, the stand may comprise a (horizontal) base and a (vertical) holder extending therefrom. The stand may include a rest that is that is attached to or integral with the far end of the holder. The rest may be configured to support the substrate. In this way, the rest may be a plate. The rest may be configured to support the inner surface of the substrate.

The inner surface of the substrate may be configured to engage with the rest for additional security. For example, the substrate may contain a mounting means that receives the rest, or that is received by the rest. For example, the mounting means may be a cylinder protruding from the inner surface of the substrate.

In one embodiment, the stand comprises a light source to illuminate the assembled puzzle. The light source of the stand may be configured to illuminate a space within a hollow substrate. The light source may suitably be positioned on the base of the stand or on the holder. In one embodiment, the stand comprises a platform, the platform being between a first end and a second end of the holder, and the platform may comprise a light source.

The puzzle may be provided in any state of construction, such as an assembled, a partially assembled, an unassembled or a disassembled state.

The invention also resides in a three dimensional substrate and/or puzzle pieces for use in the puzzle kit.

DETAILED DESCRIPTION OF THE DRAWINGS

An embodiment of the present invention will now be described with reference to the accompanying drawings, in which.

Figures 1A, 1B, 1C:
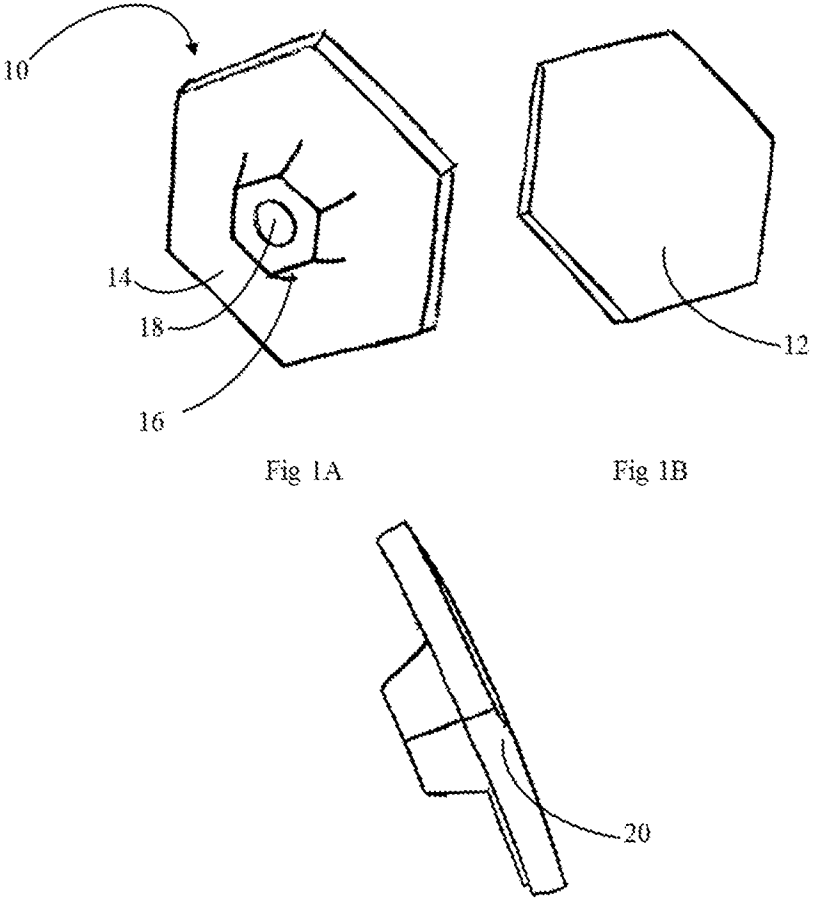
FIG. 1 shows views of a puzzle piece in accordance with embodiments of the invention.

FIG. 1 shows a puzzle piece 10 for use in embodiments of the invention. The puzzle piece 10 can be described as a tile and has a front surface 12, an opposite rear surface 14 and a thickness therebetween. As discussed in more detail below, the piece is attached to a substrate by means of a hexagonal projection 16 which extends from the rear face 14 of the piece, and which serves as a first attachment means.

The projection 16 extends from the centre point of the rear face 16 and has a longitudinal axis generally perpendicular to the rear face. The projection has a hexagonal cross-section measured in a plane perpendicular to the longitudinal axis. A diameter can also be measured in the plane perpendicular to the axis. The projection 16 tapers (narrows) away from the rear face 16 and towards a magnet 18 which is seated at the end of the projection furthest from the rear face. The magnet 18 may be a neodymium magnet.

The puzzle piece 10 is generally hexagonal, i.e. both the front face and the rear face have a generally hexagonal cross-section. As such, a plurality of the pieces will tessellate but they cannot interlock with each other.

The puzzle piece 10 is curved to align with a substrate; the front face 12 is convex and the rear face 14 is concave.

Both the front face 12 and the projection 16 have regular hexagonal cross-sections. The cross-sections are concentric i.e. they have the same centre. They are in register, i.e. one hexagon is not rotated relative to the other.

Figure 2:
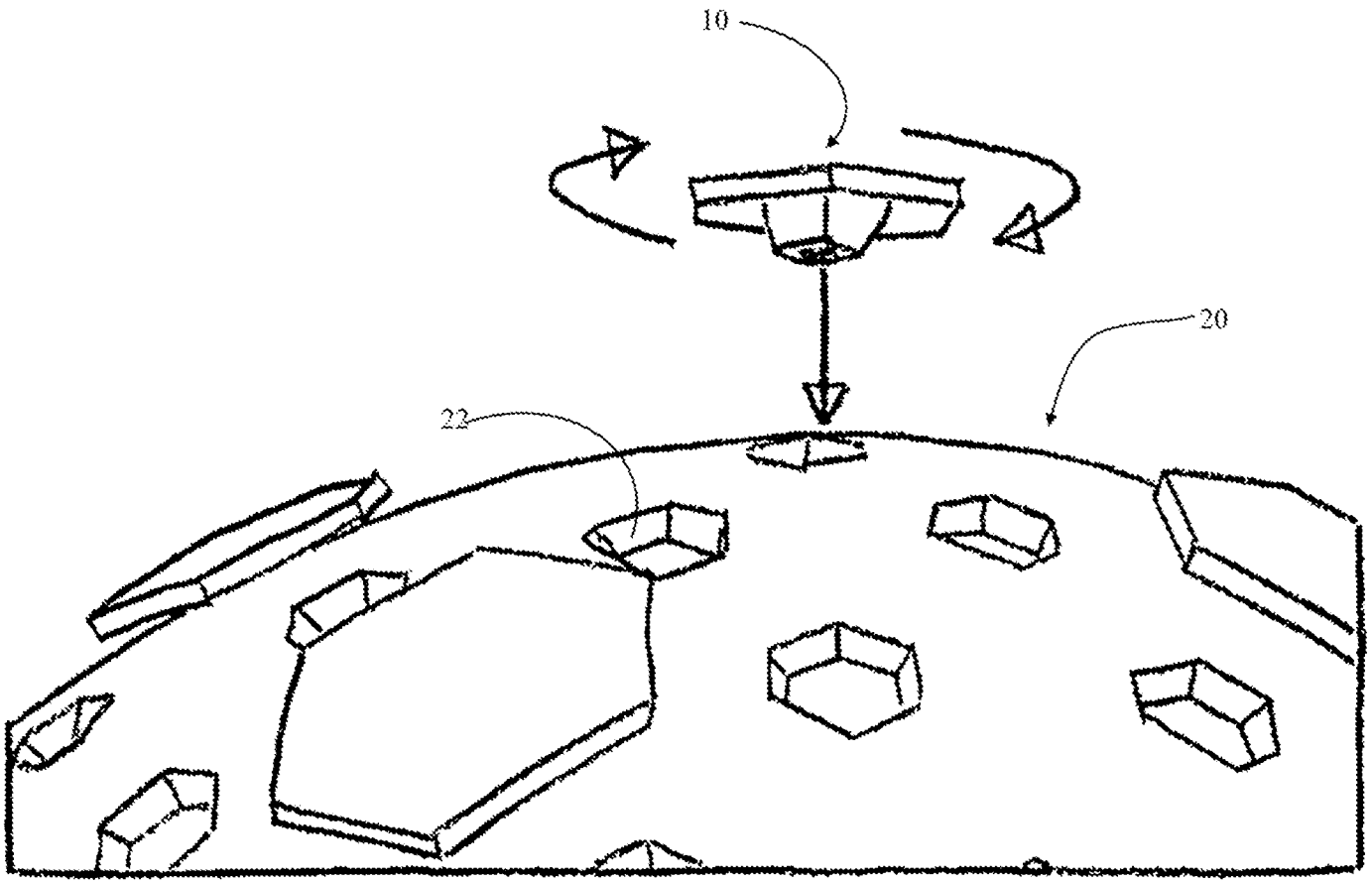
FIG. 2 is a perspective view of a portion of the substrate and a number of puzzle pieces according to embodiments of the invention.

FIG. 2 shows how the puzzle piece 10 interacts with a substrate 20. This substrate is hollow and in the shape of a helmet, but only a portion is shown. The hexagonal projection 16 having the magnet 18 therein couples to a corresponding magnet (not shown) set within a hexagonal hole or recess 22 in the outer surface of the substrate 20. This hexagonal hole 22 and the magnet form the second attachment means. It will be appreciated that it is not essential to have a magnet on both the puzzle piece and the substrate. One component could have a magnet and the other component could be magnetic (e.g. iron).

The use of a hexagonal projection 16 and corresponding hexagonal recess 22 allows the puzzle piece 10 to adopt six different orientations within the hole. This makes the puzzle more challenging that a conventional jigsaw since each position is equally likely to form the structure. Hence, a design on the front face 12 provides the clue as to its solution.

The projection 16 has a length (measured along its longitudinal axis), which is greater than the depth of the recess 22. As such, the puzzle piece 10 is spaced from the substrate 20 and held in place by the magnet 18. This allows the projection 16 to serve as a pivot (or fulcrum). Pressing down on one edge of the puzzle piece causes the opposite edge to tilt upwards. The contact between the magnets can be temporarily broken while tilting takes place. This tilting mechanism allows the pieces to be removed easily, even where a piece is surrounded by other pieces.

It will be understood that the generally triangular pieces described in GB1284872 cannot tilt for easy removal. The pieces are attached to a frame by triangular pegs that fit in triangular peg holes. As such, it would be difficult to move the pieces once in place and there would be a risk of breakage if pushed downwards on one side.

Figure 3C:
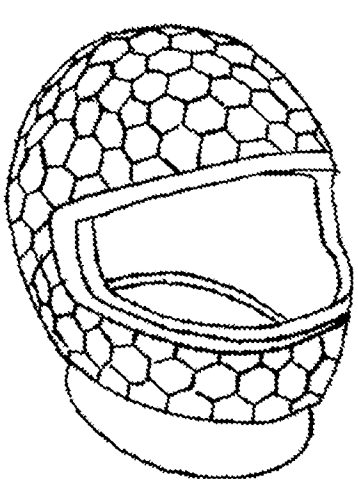
FIG. 3 shows perspective views of: a partially arranged set of the puzzle pieces with the substrate absent for clarity (3A); a substrate according to embodiments of the invention with several puzzle pieces attached to the surface (3B); and a complete puzzle according to embodiments of the invention.
Figure 3B:
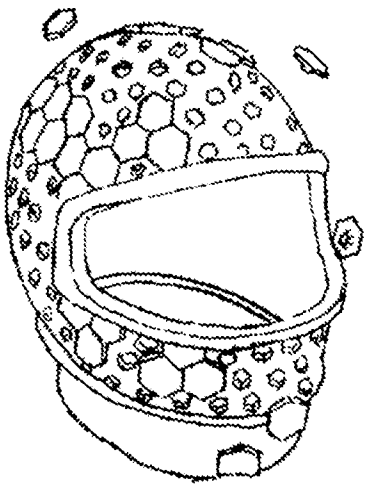
Figure 3A:
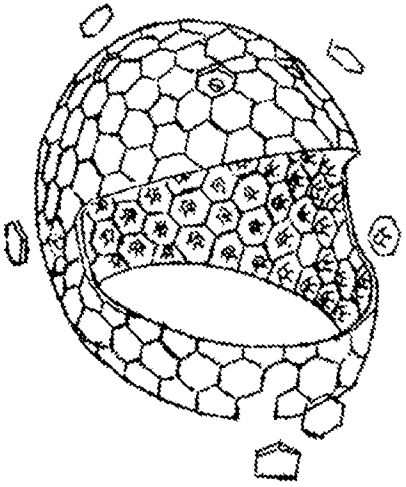

FIG. 3A shows the puzzle pieces arranged in an almost complete puzzle but without the substrate for clarity. The pieces tessellate to form one continuous surface. FIG. 3B shows the puzzle pieces arranged on the helmet shaped substrate. The helmet shaped substrate comprises a regular array of hexagonal depressions, each containing a magnet to complement those in the puzzle pieces; FIG. 3C shows a completed helmet shaped puzzle. The majority of the puzzle pieces are hexagonal but some pentagonal pieces are present to obtain the curved surface and some pieces are cropped to allow a smooth line at the edges.

Figure 4A:
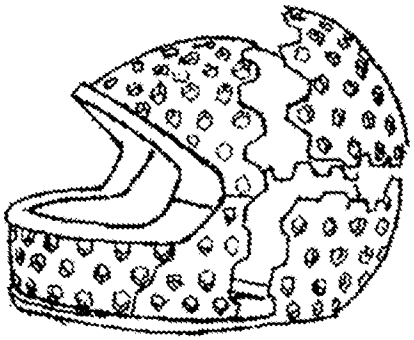
FIG. 4 shows: an exploded view of a substrate composed of multiple parts according to embodiments of the invention; a perspective view (4B) and side view (4C) of the substrate according to the same embodiment, fully constructed.
Figure 4B:
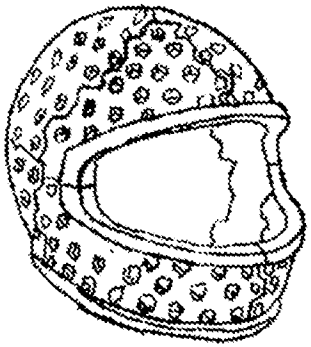
Figure 4C:
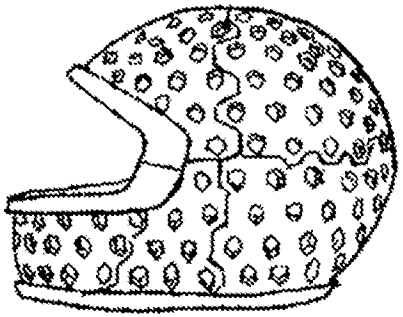

FIG. 4 shows a substrate according to one embodiment of the invention in which the substrate is composed of multiple parts which can be combined to form the helmet shaped substrate.

Figure 5A:
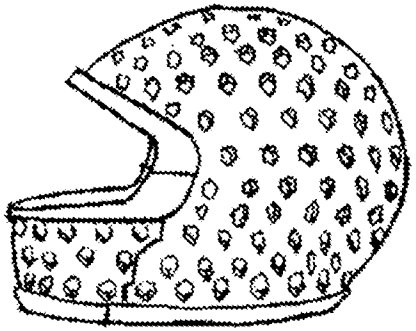
FIG. 5 shows side views of puzzle substrates, according to embodiments of the invention.
Figure 5B:
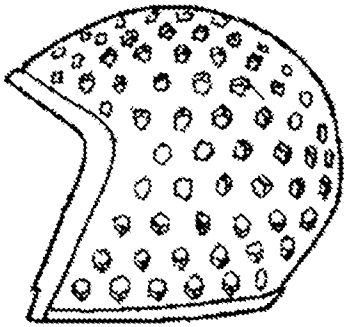
Figure 5C:
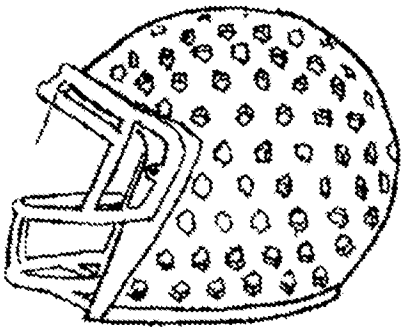

FIG. 5 shows an embodiment of the invention in which the substrate comprises multiple, interchangeable lower front sections that can be exchanged to change the look of the helmets. Curved edge pieces can be used to cover the gap between the substrate 20 and regular puzzle pieces 10 around the opening of the helmet. Such components may produce a more realistic finish to the puzzle.

Figure 6:
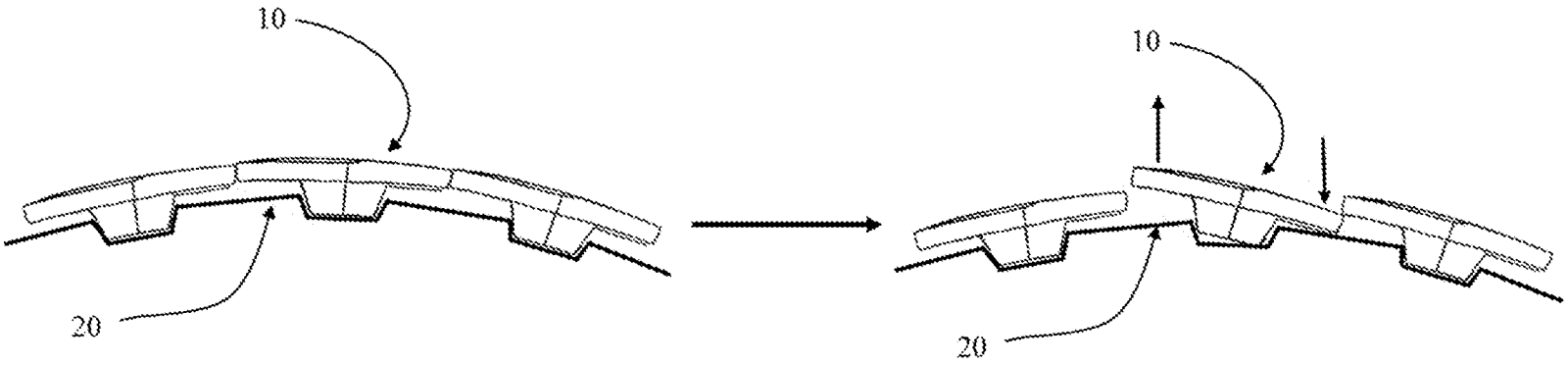
FIG. 6 is a schematic diagram demonstrating the tilting mechanism.

FIG. 6 demonstrates the tilting mechanism for easy removal of the puzzle pieces. It can be seen that the puzzle pieces 10 form a puzzle layer spaced from the substrate 20. This spacing allows the puzzle piece 10 to be pressed down on a peripheral edge (as indicated by the down arrow) and causes the opposite edge to move upwards. In this way it can be grasped by a user and removed.

Stands may be used to support a puzzle according to the present invention. A stand may comprise a base that, in use, is positioned in a horizontal plane. Each stand may also comprise a vertical member, the vertical member comprising a first end and a second end. The first end of the vertical member may be attached to the base.

A stand may comprise a light source to illuminate the puzzle. The light sources may be configured to illuminate a void of a substrate, such that light radiates from the void of the substrate.

The invention claimed is:

1. A puzzle kit comprising:

a three dimensional substrate having an outer surface; and a plurality of puzzle pieces that cannot interlock with each other, each puzzle piece having a first surface and an opposite second surface and a thickness defined between the first and second surfaces;

each puzzle piece comprising first attachment means and the outer surface of the substrate defining a plurality of complementary second attachment means, such that the first attachment means and the second attachment means attach each puzzle piece to the outer surface;

wherein the first and second attachment means are configured to magnetically attach at least one puzzle piece to the outer surface, the puzzle piece having first attachment means comprising a projection extending from the second surface of the puzzle piece and the outer surface having complementary second attachment means comprising a hole to partly receive the projection, wherein the projection has a length and the hole that receives the projection has a depth that is 90% or less of the length of the projection.

2. A puzzle comprising:

a three dimensional substrate having an outer surface; and a plurality of puzzle pieces that cannot interlock with each other, each puzzle piece having a first surface and an opposite second surface and a thickness defined between the first and second surfaces;

each puzzle piece comprising first attachment means and the outer surface of the substrate defining a plurality of complementary second attachment means, such that the first attachment means and the second attachment means attach each puzzle piece to the outer surface;

wherein the first and second attachment means magnetically attach at least one puzzle piece to the outer surface, the puzzle piece having first attachment means comprising a projection extending from the second surface of the puzzle piece and the outer surface having complementary second attachment means comprising a hole that partly receives the projection thereby forming a puzzle layer spaced from the outer surface, wherein the projection has a length and the hole that receives the projection has a depth that is 90% or less of the length of the projection.

3. The kit according to claim 1, wherein the outer surface is helmet-shaped.

4. The kit according to claim 1, wherein the depth of the hole corresponds to 50 to 80% of the length of the projection.

5. The kit according to claim 1, wherein the projection has a hexagonal cross section.

6. The kit according to claim 1, wherein at least one puzzle piece has a first surface that is hexagonal.

7. The kit according to claim 1, wherein the plurality of puzzle pieces comprise hexagonal and pentagonal puzzle pieces.

8. The kit according to claim 1, wherein the projection has a maximum diameter and the first surface has a maximum diameter that is at least two times greater than the maximum diameter of the projection.

9. The kit according to claim 1, wherein one or more puzzle pieces has a convex surface and an opposing concave surface.

10. The kit according to claim 1, wherein the plurality of puzzle pieces form a puzzle layer that extends over 50% or more of the outer surface of the substrate.

11. The kit according to claim 1, wherein the substrate is hollow.

12. The kit according to claim 1, wherein the plurality of puzzle pieces form a puzzle layer having an opening therein.

13. The kit according to claim 1, additionally comprising one or more of: a visor, a sun shield, a face guard, a vent, or an aerodynamic fin.

14. The kit according to claim 1, additionally comprising a light source or a stand.

* * * * *